US006854595B2

(12) United States Patent
Kiser

(10) Patent No.: US 6,854,595 B2
(45) Date of Patent: Feb. 15, 2005

(54) CONTAINER CLOSURE CONTAINING A MIX

(76) Inventor: Danny Kiser, 3030 68th, Lubbock, TX (US) 79413

( * ) Notice: Subject to any disclaimer, the term of this patent is extended or adjusted under 35 U.S.C. 154(b) by 159 days.

(21) Appl. No.: 10/193,903

(22) Filed: Jul. 15, 2002

(65) Prior Publication Data

US 2004/0007481 A1 Jan. 15, 2004

(51) Int. Cl.[7] ..... B65D 25/08

(52) U.S. Cl. ..... 206/222; 206/219; 215/DIG. 8; 215/11.1; 215/251; 215/10; 426/77; 426/115; 426/120; 222/129; 222/82

(58) Field of Search ..... 206/219, 220, 206/221, 222; 215/DIG. 8, 10; 222/80, 83, 83.5, 82; 426/112, 115

(56) References Cited

U.S. PATENT DOCUMENTS 3,156,369 A * 11/1964 Bowes et al. ..... 206/222
3,638,918 A * 2/1972 Denholz ..... 206/222
3,715,189 A * 2/1973 Nighohossian et al. ..... 422/61
3,785,481 A * 1/1974 Allet-Coche ..... 206/219
3,968,872 A * 7/1976 Cavazza ..... 206/222
4,294,351 A * 10/1981 Cheetham ..... 206/222
4,785,859 A * 11/1988 Gustavsson et al. ..... 141/313
5,104,008 A 4/1992 Crisci
5,246,142 A * 9/1993 DiPalma et al. ..... 222/129
5,269,425 A 12/1993 Gomez-Acevedo
5,772,017 A * 6/1998 Kang ..... 206/222
5,794,802 A 8/1998 Caola
5,954,240 A 9/1999 Duchon et al.
5,975,369 A 11/1999 Yurkewicz et al.
6,152,296 A * 11/2000 Shih ..... 206/222
6,372,270 B1 * 4/2002 Denny ..... 426/77
6,609,612 B2 * 8/2003 Vlodek ..... 206/222

FOREIGN PATENT DOCUMENTS

JP 2000102595 4/2000

* cited by examiner

*Primary Examiner*—Jila M. Mohandesi
(74) *Attorney, Agent, or Firm*—Kilpatrick Stockton LLP

(57) ABSTRACT

A container closure to be attached to a liquid container around a container opening of a liquid container. The container closure includes a storage compartment which includes a mix, such as powder or concentrated liquid. The storage compartment includes a seal or a rotating member to seal the mix within the storage compartment. A plunger unseals the seal or the rotating member is rotated to allow the mix to be mixed with the liquid in a liquid container to flavor the liquid when the container closure is attached to the liquid container.

16 Claims, 8 Drawing Sheets

CONTAINER CLOSURE CONTAINING A MIX

BACKGROUND OF THE INVENTION

1. Field of the Invention

The present invention relates to a container closure. More specifically, this invention relates to a container closure having a mix for mixing with liquid from a liquid container.

2. Background Information

Years ago, original Coke® was the only Coca-Cola® product that was available and lime flavored sports drink was the only Gatorade® product that was available. Today, Coca-Cola® and Gatorade® provide a wide assortment of flavored beverages. In addition, the number of flavored beverages from competitors has also increased. Thus, the single icebox at a convenience store that only stored Coca Cola® products has been replaced by walls of refrigerators supplying a wide assortment of beverages. The number of beverages that a store can supply is limited to the amount of space and particularly the amount of available refrigerated space. Thus, convenience stores typically provide only the more popular flavored beverages. A problem with this approach is that a store may lose business due to some consumers shopping somewhere else for a particular flavored beverage. Accordingly, there is a need for stores to provide a wider variety of beverages within the limited amount of available refrigerator space.

Similarly, there is typically limited storage space in an ice chest or cooler. For example, a family taking a long car trip may pack an ice chest of beverages for the ride. The quantity and variety of beverages is limited to the amount of space within the ice chest. Thus, there is a need to store a wider variety of beverages within the limited amount of available space within an ice chest.

SUMMARY OF THE INVENTION

The present invention disclosed herein alleviates the drawbacks described above in supplying a greater variety of beverages within a limited amount of available refrigerator space or ice chest space by providing a novel container closure. The container closures of the present invention contain a mix to be mixed with the liquid in a liquid container, thereby providing a flavored beverage. The liquid containers can be stored within a refrigerator or ice chest and one or more container closures can be stored outside of the refrigerator or ice chest. Thus, a greater variety of beverages can be offered without having to store each variety in the refrigerator or ice chest.

The container closure of the present invention is adapted to attach to a liquid container around or within a container opening. In a preferred embodiment, the container closure includes a body, a tip, an annular wall, a plunger, and a storage compartment. The annular wall extends cylindrically from the body and is adapted to slidingly receive the tip. The tip is moveable between a closed position and an open position. The tip surrounds a tip opening which is adapted to slidingly receive the plunger. The plunger is moveable between a non-piercing position in which the plunger extends out through the tip opening and a piercing position in which the plunger extends out through the storage compartment. The storage compartment contains a mix for mixing with liquid in a liquid container. The mix can be a sport drink powder, cocoa, iced tea mix, soda syrup, powdered milk, formula, minerals, vitamins, etc. The liquid can be water, milk, iced tea, carbonated water, etc.

In another embodiment, the plunger is slidingly engaged within a stem. The annular opening surrounds the stem. The annular wall surrounds the annular opening and is spaced from the stem by one or more bridging elements. The annular opening provides a path for fluids to pass through the container closure to the tip opening. The tip, the plunger and the stem are adapted to seal the upper end of the container closure when the tip is in the closed position.

In another embodiment, a rotating member resides in the storage compartment. The rotating member includes one or more channels and the storage compartment includes corresponding openings. In a rotating member can be a sealed position in which the mix is sealed in the storage compartment or can be in an aligned or mixing position in which the mix is able to interact with the liquid in the liquid container thus flavoring the liquid. An arm attached to the rotating member is used to rotate the rotating member between the sealed position and the aligned position.

In yet another embodiment, the container closure further includes a cover or dust cover releaseably attached to the container closure. The height of the cover is sufficient to allow the cover to be secured to the container closure and cover both the tip and plunger when the plunger is in a non-piercing position. The cover can include a plurality of vertical gripping ribs positioned on the outer cylindrical portion of the cover to assist in the rotation of the cover. Similarly, the body can also include a plurality of vertically positioned gripping ribs positioned on the outer cylindrical portion of the body to assist in the rotation of the container closure.

The container closure of the present invention enables a convenience store to stock liquid containers, such as water and milk, in a refrigerator and stock the container closures separately thereby conserving refrigerator space for beverages that cannot be flavored using the container closures. As a result, a convenience store is able to stock a larger variety of flavored beverages in a limited amount of refrigerator space. Similarly, the container closures of the present invention enable a person to stock liquid containers in an ice chest and stock the container closures separately, thereby conserving space within the ice chest. As a result, the ice chest can stocked to provide a larger of variety of flavored beverages in a limited space within the ice chest.

The general beneficial effects described above apply generally to each of the exemplary descriptions and characterizations of the devices and mechanisms disclosed herein. The specific structures through which these benefits are delivered will be described in detail herein below.

DETAILED DESCRIPTION OF THE INVENTION

As required, detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
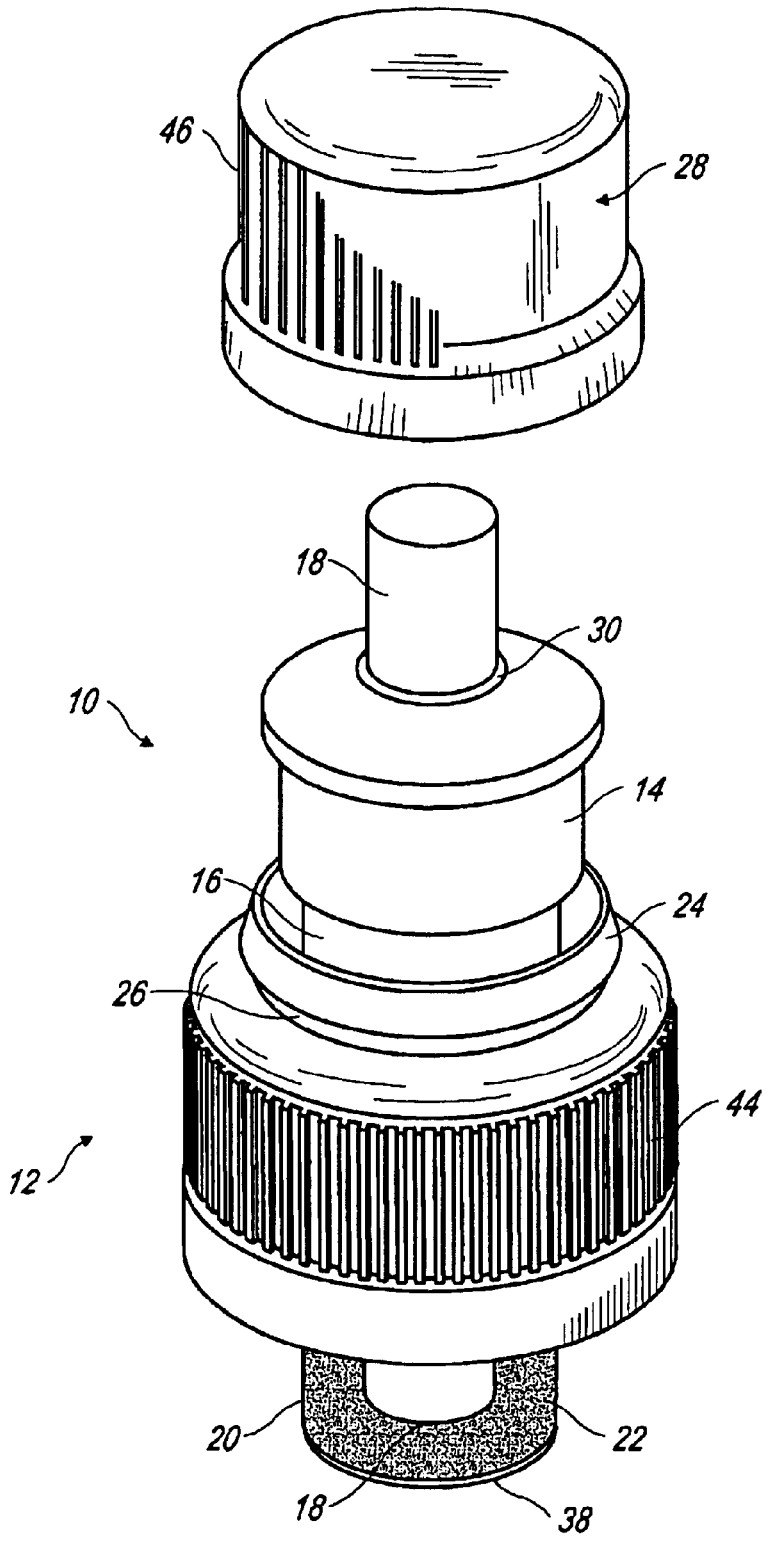
FIG. 1 is an upper perspective view of an exemplary container closure having a plunger in accordance with an embodiment of the present invention.
Figure 2:
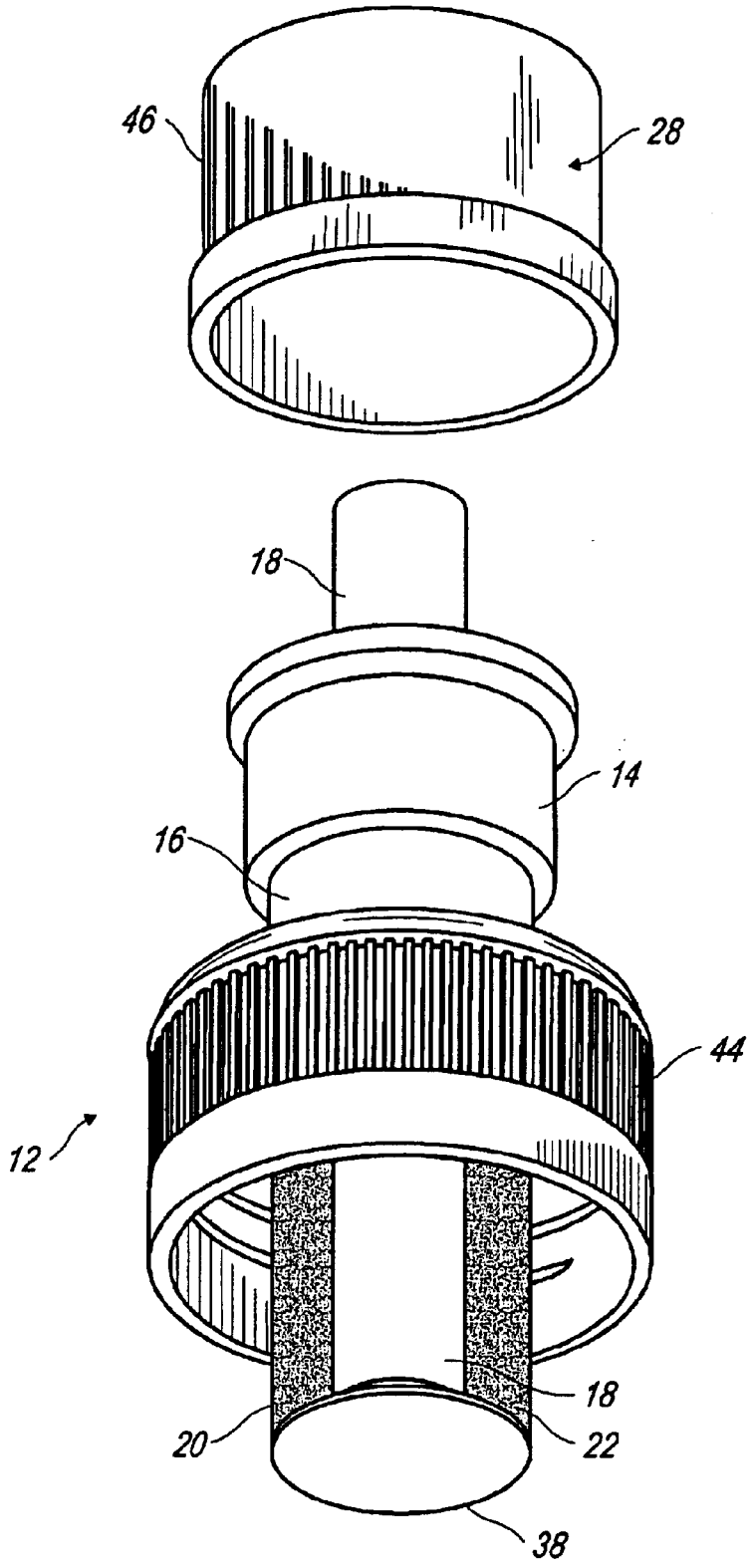
FIG. 2 is a lower perspective view of an exemplary container closure having a plunger in accordance with an embodiment of the present invention.

Referring to FIGS. 1 and 2, perspective views of an exemplary container closure in accordance with an embodiment of the present invention are illustrated. As shown, the container closure 10 includes a body 12, a tip 14, an annular wall 16, a plunger 18, and a storage compartment 20. In the preferred embodiment, the body 12 includes a plurality of vertically positioned gripping ribs 44 as known in the art. The gripping ribs are positioned on the outer cylindrical portion of the body 12 to assist in the rotation of the container closure 10. The annular wall 16 extends cylindrically from the body 12 and is adapted to slidingly receive the tip 14. The tip 14 is moveable between a closed position and an open position as known in the art. The tip 14 includes a tip opening 30 which is sealed when the tip 14 is in the closed position, and which is in fluid communication with an annular opening 32 (described in further detail below) when the tip 14 is in the open position. The annular opening 32 is in fluid communication with the storage compartment 20. The tip 14 surrounds a tip opening 30 designed to slidingly receive the plunger 18. The plunger 18 is moveable between a non-piercing position in which the plunger 18 extends out through the tip opening 30 and a piercing position in which the plunger 18 unseals the seal and extends out through the storage compartment 20.

The storage compartment 20 contains a mix 22 for mixing with liquid in a liquid container. The storage compartment 20 can be attached to or part of the annular wall 16 or can be attached to or part of the body 12. The size and shape of the storage compartment can vary as well. In the preferred embodiment, the storage compartment 20 is cylindrical in shape and is designed to fit within the container opening of a liquid container. The storage compartment 20 is sealed at the upper end when the tip 14 is in the closed position. A seal 38 is attached to the lower end of the storage compartment 20 as known in the art and discussed in further detail below.

In a preferred embodiment, the body 12 includes an upwardly extending annular ring 24 surrounding and radially spaced from the annular wall 16. The annular ring 24 includes a groove 26 configured for securing a cover or dust cover 28. The undercut 26 is configured to interact with an annular ring (not shown) on the cover 28 to secure the cover 28 to the container closure 10. In alternate embodiments, the cover 28 is secured to the container closure 10 using means known in the art. The height of the cover 28 is sufficient to allow the cover 28 to be secured to the container closure 10 and cover the tip 14 and the plunger 18 with the plunger 18 in a non-piercing position. In the preferred embodiment, the cover 28 includes a plurality of vertical gripping ribs 44 as known in the art. The gripping ribs 44 are positioned on the outer cylindrical portion of the cover 28 to assist in the rotation of the cover 28.

Figure 3:
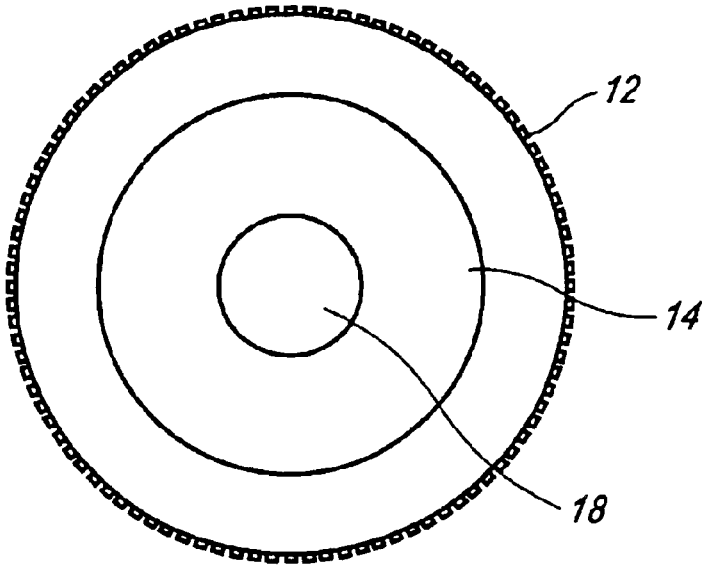
FIG. 3 is a top view of an exemplary container closure in accordance with an embodiment of the present invention.

Referring to FIG. 3, a top view of an exemplary container closure, without a cover, in accordance with an embodiment of the present invention is illustrated. As shown, the tip 14 receives the plunger 18. The tip 14 resides on the annular wall 16 which is attached to the body 12.

Figure 4:
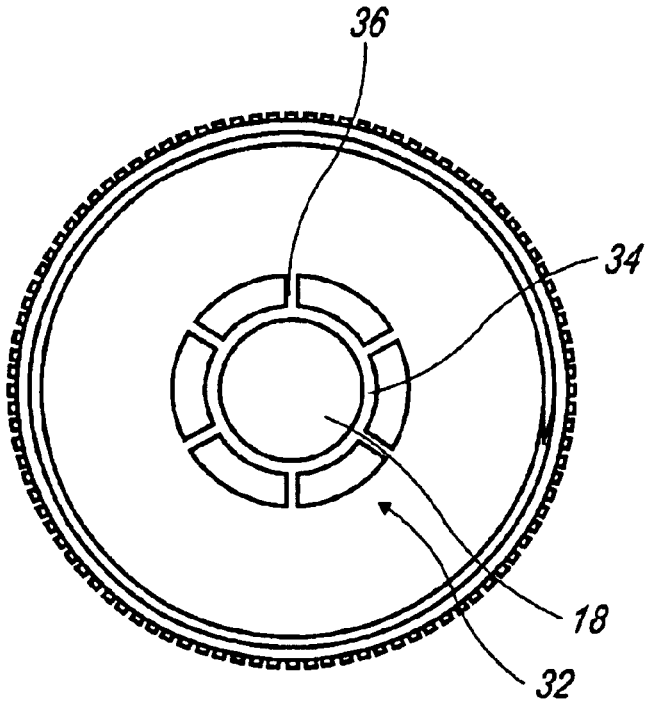
FIG. 4 is a cross sectional view of an exemplary container closure in accordance with an embodiment of the present invention.

Referring to FIG. 4, a cross sectional view of an exemplary container closure in accordance with an exemplary embodiment of the present invention. The cross sectional view is at about the at about the annular wall 16 of FIG. 1. As shown, the stem 34 is surrounded by the annular opening 32. The annular wall 16 surrounds the annular opening 32 and is spaced from the stem 34 by one or more bridging elements 36. The annular opening 32 provides a path for fluids to pass through the container closure 10 to the tip opening 30. The tip 14, the plunger 18 and the stem 34 are adapted to seal the upper end of the container closure 10 when the tip 14 is in the closed position. In an alternate embodiment, the body 12 does not include a stem 34 or bridging elements 36. In this embodiment, the tip 14 and the plunger 18 are adapted to seal the upper end of the container closure 10 when the tip 14 is in the closed position.

Figure 5A:
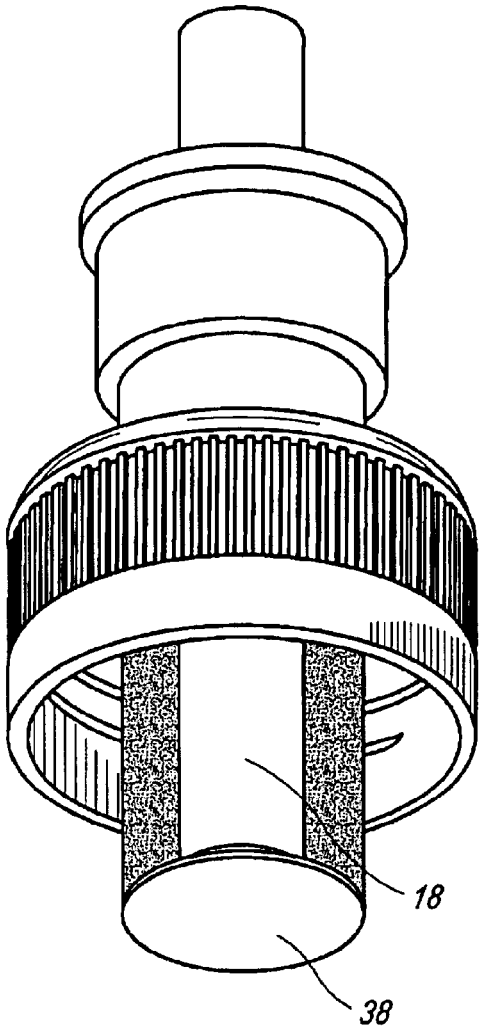
FIG. 5*a* is a perspective view of an exemplary container closure with the plunger in a non-piercing position in accordance with an embodiment of the present invention.
Figure 5B:
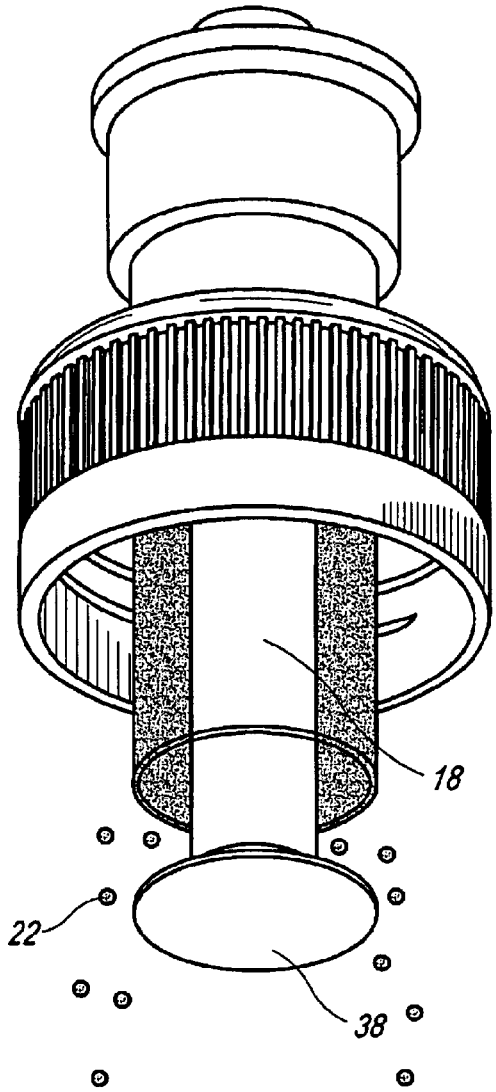
FIG. 5*b* is a perspective view of an exemplary container closure with the plunger in a piercing position in accordance with an embodiment of the present invention.

Referring to FIG. 5A and 5B, exemplary container closures with the seal in the sealed position and the seal in the unsealed position, respectively, in accordance with an embodiment of the present invention are illustrated. As shown in FIG. 5A, the seal 38 is adapted to seal the lower end of the storage compartment 20 when the seal 38 is intact. As shown in FIG. 5B, the seal is adapted to allow for fluid communication between the storage compartment 20 and the liquid container once the seal 38 is unsealed by the plunger 18, e.g., broken, pierced or moved. The seal 38 can consist of a thin foil, plastic or other material known in the art. The mix 22 stored in the storage compartment 20 can include, but is not limited to, powdered mix and concentrated liquid. Examples of mixes 22 can include sport drink powder, cocoa, iced tea mix, soda syrup, powdered milk, formula, minerals, vitamins, etc.

Figure 6:
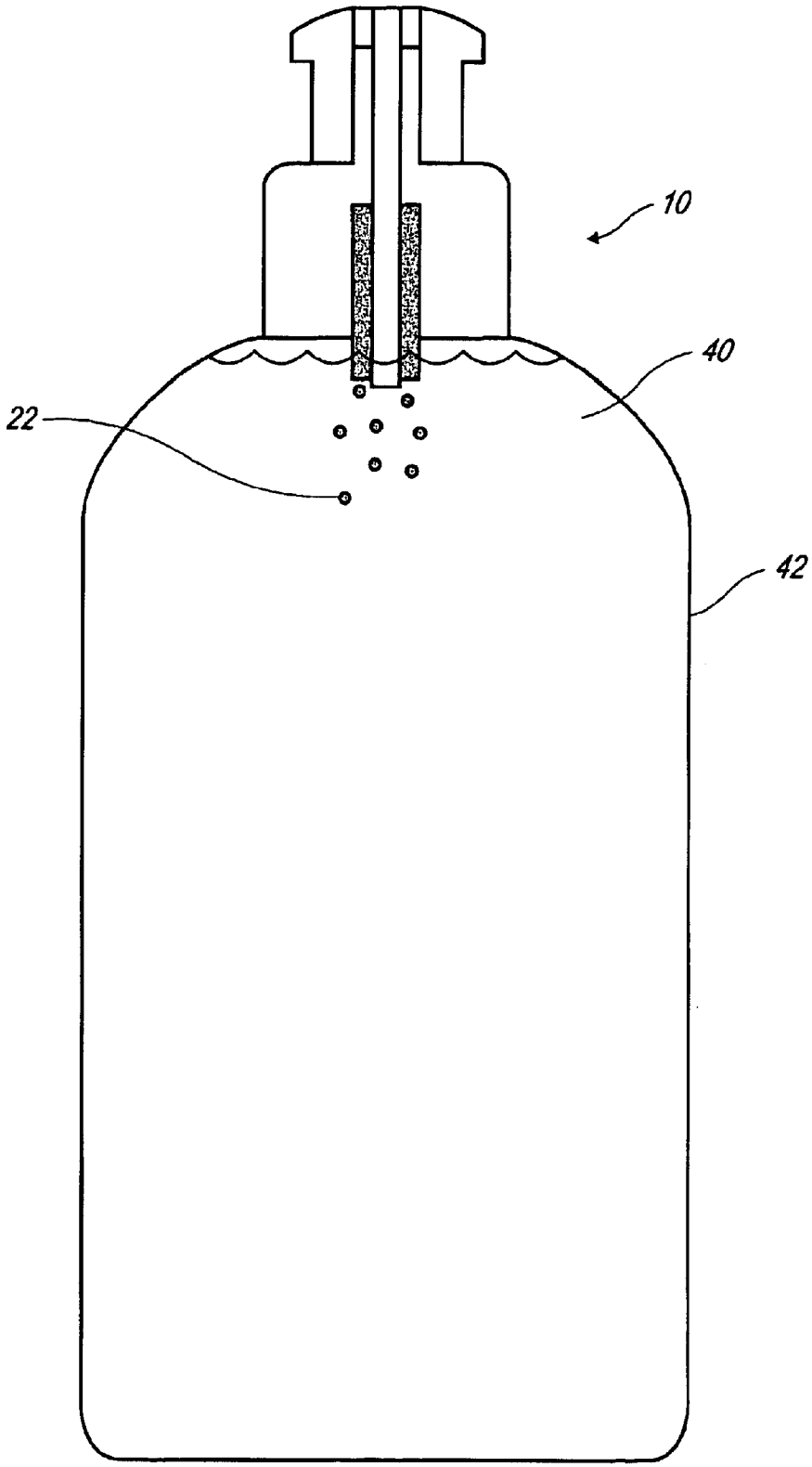
FIG. 6 is a cross-sectional view of an exemplary container closure attached to a liquid container with the plunger in the piercing position in accordance with an embodiment of the present invention.

Referring to FIG. 6, a cross-sectional view of an exemplary container closure attached to a liquid container with the plunger in the piercing position in accordance with an embodiment of the present invention is illustrated. As shown, the tip 14 is in the closed position with the top end of the plunger 18 being substantially flush with the top surface of the tip 14. The bottom end of the plunger 18 is adapted to unseal the seal 38 once pressure is applied to the top end of the plunger 18. Pressure on the top end of the plunger 18 causes the plunger 18 to slide downwardly and unseal the seal 38 at the lower end of the storage compartment 20. In a preferred embodiment, the plunger 18 includes one or more stop elements (not shown) adapted to stop the plunger 18 at a desired position, e.g., where the plunger 18 is substantially flush with the top surface of the tip 14. Once the seal 38 is pierced, the mix 22 in the storage compartment can be in fluid communication with the liquid 40 in the liquid container 42, thus causing the mix 22 and the liquid 40 to interact. The liquid 40 can include, but is not limited to, water, milk, iced tea, carbonated water, etc.

To use the container closure 10 of the present invention, a container closure 10 is attached to a liquid container 42 using means known in the art. For example, the body 12 of the container closure 10 includes slots which mate with grooves on the liquid container 42 when the container closure 10 is screwed onto the liquid container 42. Once the cover 28 is removed from the container closure 10, pressure is applied to the plunger 18 to slide the plunger 18 downward piercing the seal 38 on the bottom of the storage compartment 20 thus allowing the mix 22 and the liquid 40 to flavor the beverage. If necessary, the consumer would then shake the liquid container 42 having the attached container closure 10 to mix or combine the liquid 40 with the mix 22. To drink the beverage, the tip 14 is moved into the open position which allows the liquid to flow from the liquid container 42, through the container closure and out through the tip opening 30 when the liquid container 42 is sufficiently tilted.

In another embodiment, not shown, the plunger can be stationary with the storage compartment being moved between a non-piercing position and a piercing position. In this embodiment, the storage compartment is connected to the tip thus allowing the seal on the storage compartment to be unsealed, e.g., broken, pierced, or moved, when the tip is moved upward towards the open position, thus allowing fluid communication between the storage compartment 20 and the liquid container 42.

Figure 7A:
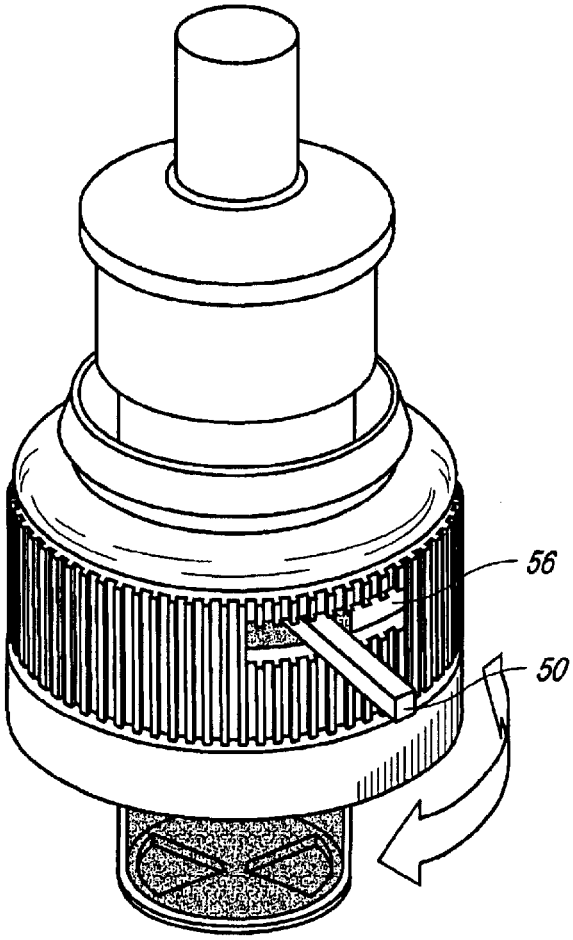
FIG. 7*a* is a perspective view of the upper section of an exemplary container closure having a rotating storage container in accordance with an embodiment of the present invention.
Figure 7B:
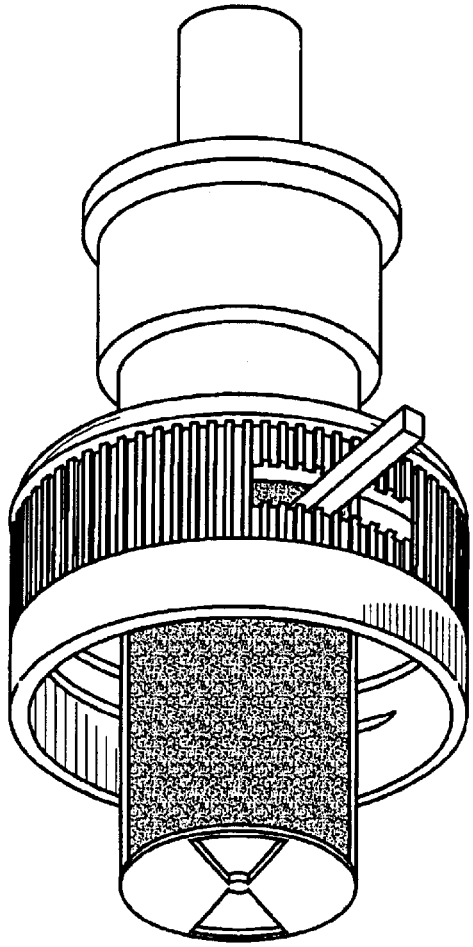
FIG. 7*b* is a perspective view of the lower section of an exemplary container closure having a rotating storage container in accordance with an embodiment of the present invention.
Figure 8:
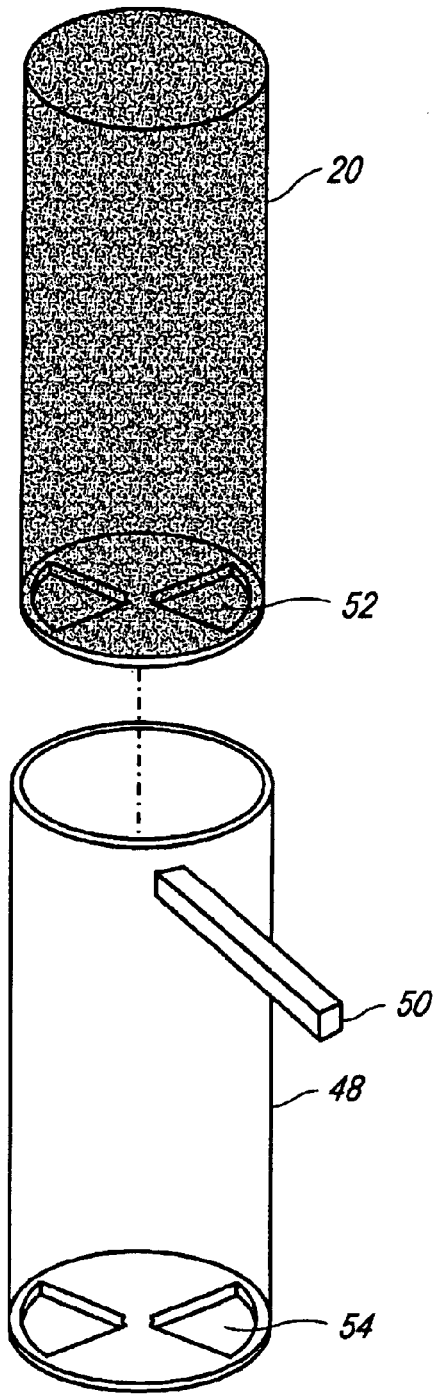
FIG. 8 is a perspective view of an exemplary container closure having a rotating member in accordance with an embodiment of the present invention.

Referring to FIGS. 7*a* and 7*b*, an exemplary container closure having a rotating member in accordance with an embodiment of the present invention is illustrated. As shown, the body 12 includes a slot 56 in which an arm 50 extends from the slot 56. The arm 50 moves between a sealed position in which the mix 22 is sealed within the storage compartment 20 and a mixing position or aligned position in which the mix 22 mixes with liquid 40 in the liquid container 42. Referring to FIG. 8, a perspective view of an exemplary container closure having a rotating member in accordance with an embodiment of the present invention is illustrated. As shown, the storage container 20 resides within the rotating member 48. The bottom of the storage container 20 includes one or more channels 52 and the bottom of the rotating member 48 includes one or more corresponding openings 54. The channels 52 and openings 54 are positioned such that when the rotating member 48 is in a sealing position, the channels 52 and openings 54 are not aligned thus the mix 22 is sealed within the storage compartment 20 and when the rotating member 48 is in a mixing or aligned position, the channels 52 and openings 54 are aligned thus allowing the mix 22 to be mixed with the liquid 40 in a liquid container 42. The arm 50 is used to move or rotate the rotating member 48, thus aligning the channels 52 and the openings 54. In a preferred embodiment, initially, the arm 50 is secured in the sealed position using means as known in the art. In alternate embodiments, the arm 50 can be a tab, a dial, or any other element that can move or rotate the rotating member 48.

Figure 9:
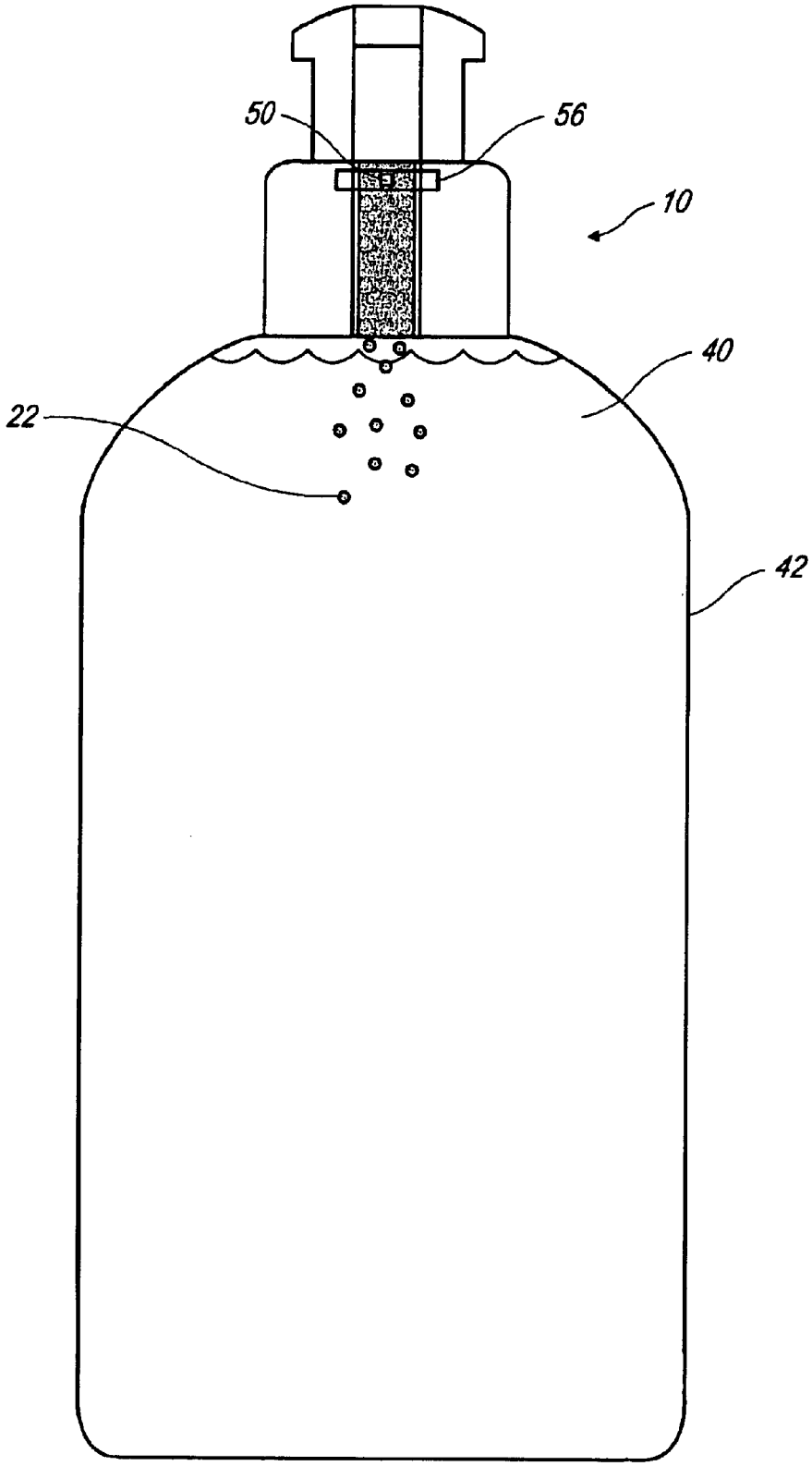
FIG. 9 is a cross-sectional view of an exemplary container closure attached to a liquid container with the rotating storage compartment in a mixing position in accordance with an embodiment of the present invention.

Referring to FIG. 9, a cross-sectional view of an exemplary container closure attached to a liquid container with the rotating storage compartment in an aligned position or mixing position in accordance with an embodiment of the present invention. As shown, the arm 50 is in aligned position or mixing position, thus allowing the mix 22 to interact with the liquid 40 in the liquid container 42.

To use the container closure 10 of the present invention, a container closure 10 is attached to a liquid container 42 using means known in the art. For example, the body 12 of the container closure 10 includes slots which mate with grooves on the liquid container 42 when the container closure 10 is screwed onto the liquid container 42. The arm 50 is moved into the mixing position, thus allowing the mix 22 and the liquid 40 to flavor the beverage. If necessary, the consumer would then shake the liquid container 42 having the attached container closure 10 to mix or combine the liquid 40 with the mix 22. To drink the beverage, the tip 14 is moved into the open position which allows the liquid to flow from the liquid container 42, through the container closure and out through the tip opening 30 when the liquid container 42 is sufficiently tilted.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

Industrial Applicability

The present invention finds applicability in the beverage community, and more specifically in container closures for liquid containers. The container closures contain a storage compartment having a flavoring mix to be mixed with the liquid within the liquid container thus providing a flavored beverage.

What is claimed is:

1. A container closure adapted to attach to a liquid container at a container opening, the container closure comprising:

a body;

an annular wall extending from the body and surrounding an annular opening;

a tip received on the annular wall and moveable between a closed position sealing an upper end of the container closure and an open position;

a storage compartment adapted to store a mix;

a seal adapted to seal a lower end of the storage compartment in a sealed position; and a plunger adapted to unseal the seal thereby allowing interaction between the mix and liquid in the liquid container when the container closure is attached to a liquid container with the container closure adapted to allow the liquid to pass through the storage compartment and pass through the annular opening.

2. The container closure of claim 1 wherein the plunger moves between a non-piercing position in which the seal remains intact and a piercing position in which the plunger unseals the seal thereby allowing interaction between the mix and the liquid in the beverage container when the container is attached to a liquid container.

3. The container closure of claim 2 wherein the tip further comprises a tip opening wherein the plunger extends from the tip opening when the plunger is in a non-piercing position.

4. The container closure of claim 1 further comprising a stem surrounded by the annular opening and at least one bridging element connecting the stem and the annular wall.

5. The container closure of claim 1 wherein the storage compartment is attached to the body.

6. The container closure of claim 1 wherein the storage compartment is attached to the annular wall.

7. The container closure of claim 1 further comprising a mix stored in the storage compartment.

8. The container closure of claim 7 wherein the mix is selected from the group consisting of a powder mix and a concentrated liquid.

9. The container closure of claim 1 further comprising a cover releasable attached to the container closure.

10. A beverage container comprising:

a liquid container adapted to store a liquid and comprising a container opening; and a container closure adapted to attach to the liquid container around the container opening, the container closure comprising:

a body;

an annular wall extending from the body and surrounding an annular opening;

a tip received on the annular wall and moveable between a closed position sealing an upper end of the container closure and an open position;

a storage compartment adapted to store a mix;

a seal adapted to seal a lower end of the storage compartment in a sealed position; and a plunger adapted to unseal the seal thereby allowing interaction between the mix and liquid in the liquid container when the container closure is attached to a liquid container with the container closure adapted to allow the liquid to pass through the storage compartment and pass through the annular opening.

11. The beverage container of claim 10 wherein the plunger moves between a non-piercing position in which the seal remains intact and a piercing position in which the plunger unseals the seal thereby allowing interaction between the mix and the liquid in the beverage container when the container is attached to a liquid container.

12. The beverage container of claim 11 wherein the tip further comprises a tip opening wherein the plunger extends from the tip opening when the plunger is in a non-piercing position.

13. The beverage container of claim 10 further comprising a mix stored in the storage compartment.

14. The beverage container of claim 13 wherein the mix is selected from the group consisting of a powder mix and a concentrated liquid.

15. The beverage container of claim 14 further comprising a liquid stored in the liquid container.

16. The beverage container of claim 10 wherein the liquid is selected from the group consisting of water, carbonated water and milk.

* * * * *